US005677601A

United States Patent [19]

Zuchtriegel

[11] Patent Number: 5,677,601

[45] Date of Patent: Oct. 14, 1997

[54] OPERATING CIRCUIT FOR LOW-POWER LOW-PRESSURE DISCHARGE LAMPS, PARTICULARLY COMPACT FLUORESCENT LAMPS

[75] Inventor: Anton Zuchtriegel, Taufkirchen, Germany

[73] Assignee: Patent-Treuhand-Gesellschaft F. Elektrische Gluehlampen mbH, Munich, Germany

[21] Appl. No.: 512,942

[22] Filed: Aug. 9, 1995

[30] Foreign Application Priority Data

Aug. 26, 1994 [DE] Germany ..... 44 30 397.1

[51] Int. Cl.[6] ..... H05B 41/36

[52] U.S. Cl. ..... 315/209 R; 315/205; 315/224; 315/247; 363/39

[58] Field of Search ..... 315/247, 205, 315/209 R, 224; 363/39, 44

[56] References Cited

U.S. PATENT DOCUMENTS 4,808,887 2/1989 Fahnrich et al. ..... 315/247
5,068,573 11/1991 Bruning et al. .

FOREIGN PATENT DOCUMENTS 44 00 436 8/1994 Germany .
174057 3/1989 Japan ..... 315/247

*Primary Examiner*—Robert Pascal
*Assistant Examiner*—Arnold Kinkead
*Attorney, Agent, or Firm*—Frishauf, Holtz, Goodman, Langer & Chick, P.C.

[57] ABSTRACT

To meet IEC regulations in accordance with IEC publication 555-2 class D, for harmonic content of feedback into power networks upon use of low-power fluorescent lamps, an operating circuit for a lamp, or serially connected lamps is provided which includes a rectifier (2), rectifying a-c input energy, and having a smoothing capacitor (C3) connected across its output (J1, J2), the output of which is inverted in a half-bridge inverter using alternately conductive transistors (T1, T2), a passive filter circuit (5) is connected between an electrode of the lamp, or the last electrode of the lamps and a return connection to the rectifier (2). The passive filter circuit (5) has two serially connected diodes (D1, D2) defining a common junction (M2), connected in d-c blocking direction in a connection line between the second electrode (E2, E4') of a lamp (LP1) or the last of a group of serially connected lamps (LP1', LP2') and one (J1) output terminal of the rectifier (2). A first capacitor (C1) is connected to the common junction (M2) between the two diodes (D1, D2), and coupled to the other (J2) of the output terminals of the rectifier (2); and a second capacitor (C2) is connected in parallel across the serially connected two diodes (D1, D2).

3 Claims, 3 Drawing Sheets

OPERATING CIRCUIT FOR LOW-POWER LOW-PRESSURE DISCHARGE LAMPS, PARTICULARLY COMPACT FLUORESCENT LAMPS

Reference to related patent, assigned to the assignee of the present invention, the disclosure of which is hereby incorporated by reference: U.S. Pat. No. 4,808,887, F ähnrich and Zuchtriegel.

FIELD OF THE INVENTION

The present invention relates an operating circuit for high-frequency operation of one, or a plurality of serially connected low-pressure discharge lamps, particularly compact fluorescent lamps, of low power rating, for example of power ratings of 25 W or less.

BACKGROUND

Fluorescent lamps, and especially compact fluorescent lamps, are preferably operated with high-frequency electrical energy, obtained from a power network through a rectifier and an inverter connected thereto. The operating frequency, typically, is in the 10 to 100 kHz range. Circuits of this type usually have a network rectifier, the output of which is connected to a smoothing capacitor, and an inverter which includes two alternately conductive transistors. Such circuits generate harmonics which are fed back into the energy supply network. The harmonics within the energy supply networks, however, must be limited. As from 1996 the harmonic content, in accordance with IEC (International Electrotechnical Commission) publication 555-2, must meet the requirements of class C for ballasts or converters having a power rating higher than 25 W; as from 1998 compact fluorescent lamps, their ballasts and adapters of 25 W power rating or lower than 25 W power rating must meet the requirements of class D of IEC publication 555-2.

The size of the smoothing capacitor is proportional to the power acceptance of the lamp. Thus, accessory circuits for lamps larger than 25 W require smoothing capacitors of higher capacity value. The result, however, is a high harmonic content so that it is necessary to provide active harmonic filter circuits including complex pumping circuits having capacitors and diodes in order to be able to meet the IEC class C requirements. One such circuit is described in the referenced U.S. Pat. No. 4,808,887, Fähnrich and Zuchtriegel. These active circuits, however, introduce additional radio noise which can be suppressed only by complex noise suppression circuits having multiple numbers of components.

THE INVENTION

It is an object to provide a circuit arrangement to operate low-power low-pressure discharge lamps, typically fluorescent lamps and especially compact fluorescent lamps, of equal to or less than 25 W power rating, and which will result in a network harmonic content which is below the limit set by the IEC publication class D, and to do so with a minimum number of components, and at minimum expense.

Briefly, a passive filter circuit is provided formed by two serially connected diodes, connected in d-c blocking direction. These diodes are connected within a connection line between a second electrode, or the last one of a series of serially connected electrodes of low-pressure discharge lamps, and one terminal, for example the positive terminal of the rectifier. A first capacitor is connected to the common junction between the two serially connected diodes and coupled to the other one, then the negative terminal of the rectifier. A second, or coupling, and a-c bypass capacitor is connected in parallel, that is, across the two diodes.

Preferably, the capacity relationships between the first capacitor and the second capacitor is equal to or greater than 4.

The filter including the two diodes and two capacitors ensures reliable operation of the half-bridge transistor inverter when the a-c network power supply sine voltage passes through zero or null. The circuit, not being an active circuit like the pump circuit in accordance with the prior art but, rather, being a passive circuit, introduces only small radio noise interference, so that the radio noise suppression portion of the overall circuit can be held to a minimum number of components. The circuit to, reduce the harmonics, uses capacitors of low capacity values, and the smoothing capacitor, itself, can be of low capacity. Thus, inexpensive foil capacitors can be used in the smoothing circuit.

The circuit has a high-power factor, of greater than 0.9, due to the low charge capacity of the smoothing capacitor, and by connection of one lamp electrode, or, rather, the second lamp electrode of the last lamp in a series of lamps to the harmonic filter circuit of the invention, which also contributes to the high power factor as well as efficient harmonic filtering.

A circuit like the passive network as described using only two diodes and two capacitors can be easily constructed in minimum space, since all capacitors can be formed as foil capacitors which, as an additional advantage with respect to electrolytic capacitors, have a high long-time stability with respect to temperature.

The filter circuit in accordance with the present invention further permits saving of one coupling capacitor in series to the usually present resonance inductance in a series resonance circuit to supply the lamp, since the second, or a-c bypass capacitor of the harmonic filter circuit, connected in parallel to the diodes, can, simultaneously, function as a coupling capacitor.

DRAWINGS

DETAILED DESCRIPTION

Figure 1:
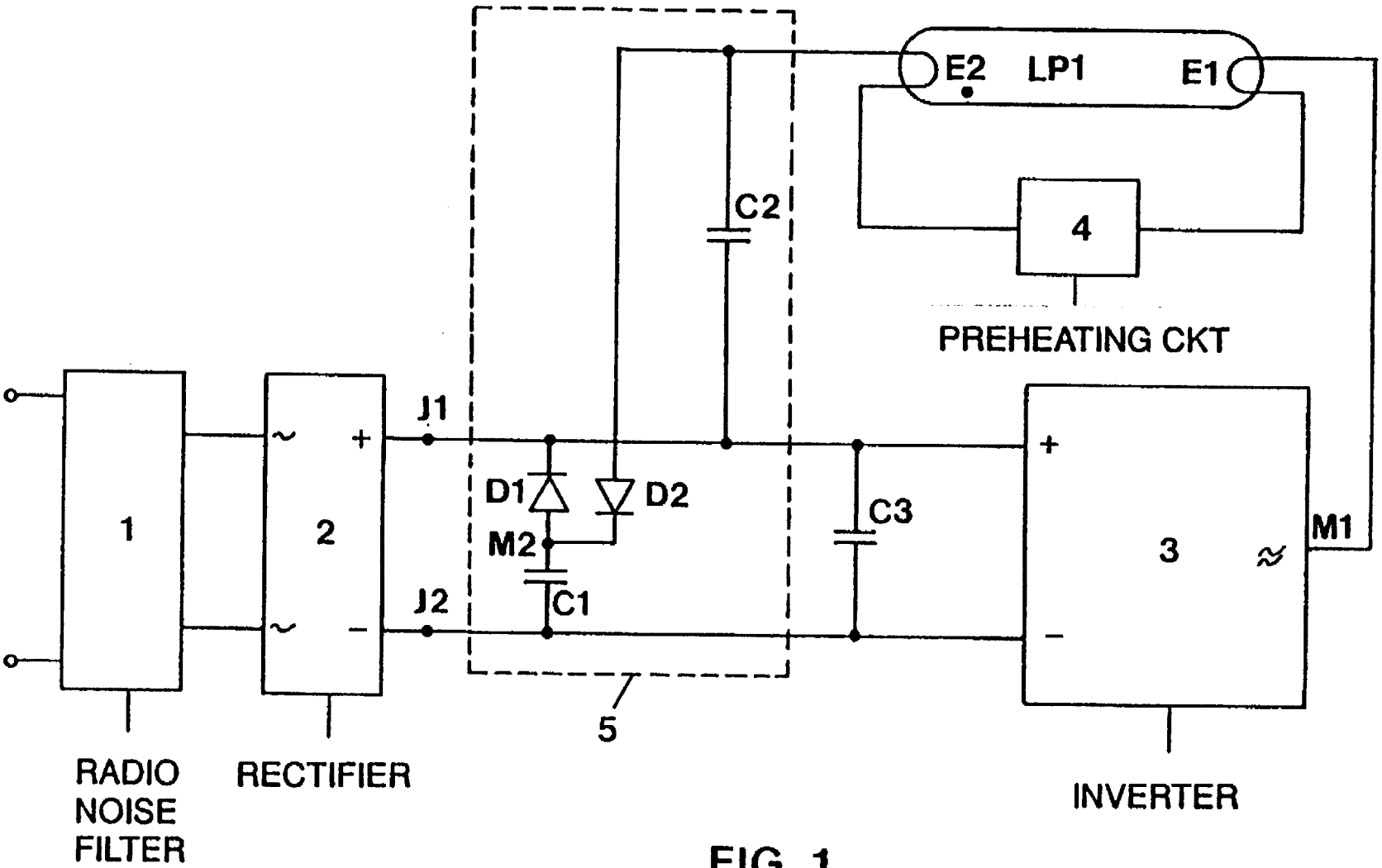
FIG. 1 is a highly schematic block circuit diagram of the circuit arrangement of the present invention for one low-power compact fluorescent lamp.

Referring first to FIG. 1, which illustrates the general principle of the present invention, applied to, or in combination with a low-power compact fluorescent lamp. The circuit has a radio noise filter 1, a rectifier 2, and a two-semiconductor, typically transistor, half-bridge inverter circuit 3. The circuit 3, in the diagram of FIG. 1, further includes a control circuit portion for the transistors, and a resonance inductance. The center connection M1 of the two transistors in the half-bridge circuit 3 is connected to the positive terminal J1 of the rectifier 2 through a compact fluorescent lamp LP1. A preheating circuit 4 is connected across the lamp LP1.

In accordance with the present invention, a harmonic filter circuit 5 is provided, formed by two serially connected diodes D1, D2 in the connection from the second electrode E2 of the lamp LP1 to positive terminal J1 of the rectifier 2. The diodes D1, D2 are connected in d-c blocking direction. A center terminal M2 between the two diodes D1, D2 is coupled by a first capacitor C1 with the negative terminal J2 of the rectifier 2. A second, or bypass or cross-connected capacitor C2 is connected across the two diodes D1, D2.

In accordance with a preferred feature of the invention, the ratio of capacity values between capacitor C1 and capacitor C2, expressed mathematically, is $$C1/C2 \geqq 4 \quad (1)$$

Figure 2:
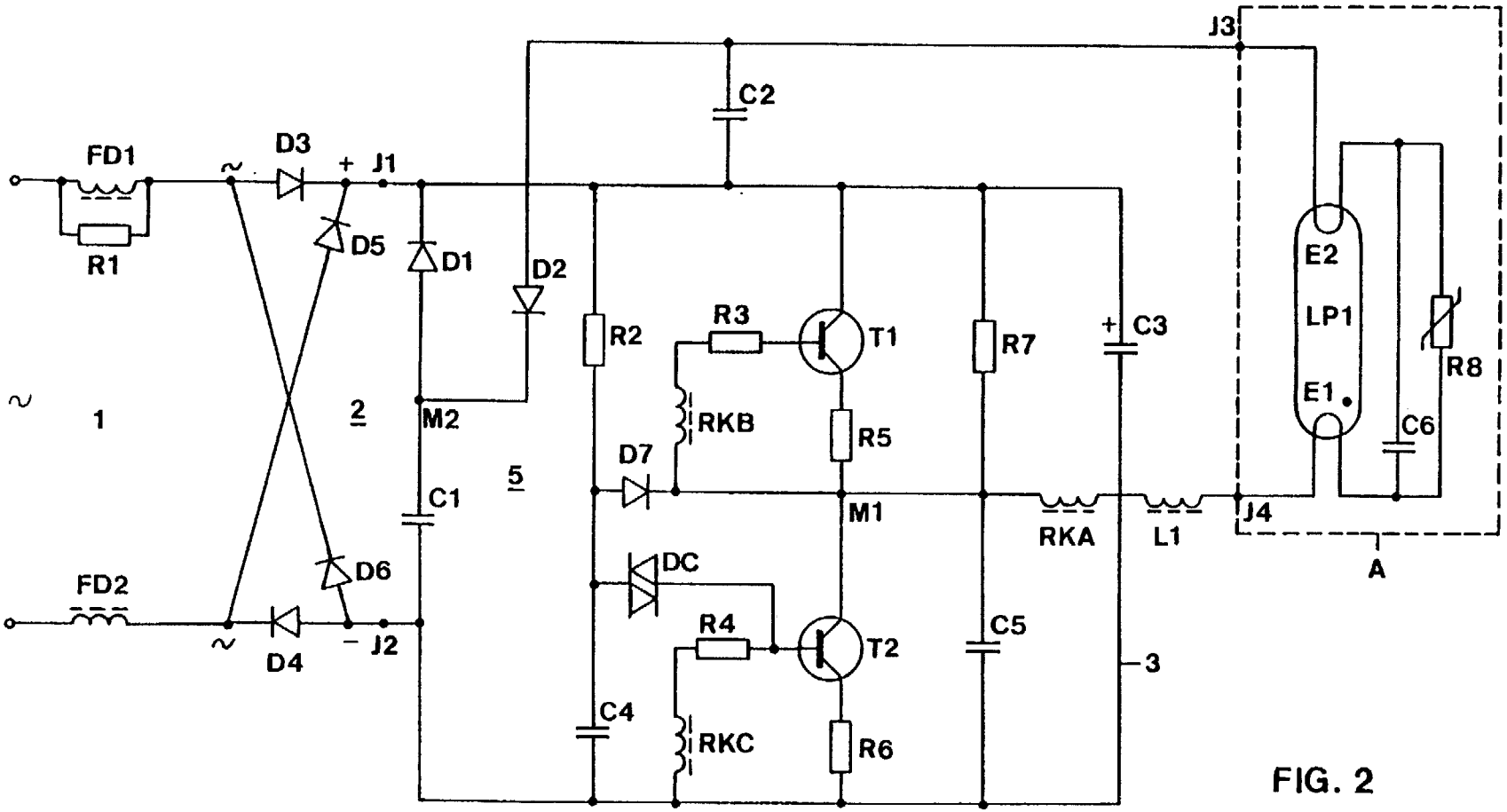
FIG. 2 is a detailed circuit diagram of the circuit of FIG. 1.

FIG. 2 illustrates the circuit diagram in detail, to operate a low-pressure discharge lamp in accordance with the schematic block diagram of FIG. 1.

An a-c power supply has its input terminals connected through filter chokes FD1, FD2, each to the rectifier 2. At least one of the filter chokes is bridged by a resistor R1. The filter chokes and resistors form the radio noise filter which is directly connected to the rectifier 2, formed by diodes D3, D4, D5, D6 and connected in conventional manner.

The output circuit of the rectifier 2 has a smoothing capacitor C3 connected thereacross.

The inverter is a push-pull frequency generator which is self-controlling and formed by two switching transistors T1, T2, resistors R3, R4, R5, R6, control signal coupling resistors R2, R7, a starting capacitor C4, diode D7, as well as the diac DC. The control signal transfers circuit includes a feedback circuit formed by a primary winding RKA and two secondary windings RKB and RKC. The lamp LP1 has one electrode E1 connected at one terminal to the center connection M1 between the transistors T1 and T2. The other electrode E2 of the lamp LP1 is connected to the positive terminal J1 of the rectifier 2. A series resonance circuit formed by the inductance L1, and resonance capacitor C6 is provided; the resonance inductance L1 is connected between the primary winding RKA of the oscillator, transformer or control signal transfer device and the corresponding terminal of the electrode E1 of the lamp LP1. The resonance capacitor C6 is connected between the other terminals of the electrodes El, E2 of the lamp. The smoothing capacitor C3, as can be seen, is connected in parallel to the switching path of the transistors T1, T2. The capacitor C5 is connected in parallel to the transistor T2 and is used for additional radio noise suppression, in form of a trapeze capacitor. A positive temperature coefficient (PTC) resistor R8 is connected across the electrodes E1, E2 in order to improve the preheating characteristics of the lamp LP1. The resistor R8 together with the capacitor C6 in effect, forms effectively the preheating circuit 4 (FIG. 1).

The operation of the circuit with a half-bridge inverter and a series resonance circuit for ignition and operation of discharge lamps is well known, and reference is made to the above-referred to U.S. Pat. No. 4,808,887, Fähnrich and Zuchtriegel; for further details, patent and literature references there disclosed may be consulted.

In accordance with the present invention, the harmonic filter circuit 5 is formed of two diodes D1, D2, preferably of the type 1N4005, which are high-speed type diodes. These diodes are serially connected and define a common junction M2. The diodes are connected in d-c blocking direction between the one terminal, here the positive terminal J1 of the rectifier 2 and the corresponding terminal of the second electrode of the low-pressure discharge lamp LP1. The diode series circuit, thus, provides a connection between the electrode E2 and the one terminal J1 of the rectifier 2. The junction M2 between the two diodes D1, D2 is connected through a first capacitor C1 with the other negative terminal of the rectifier 2; a second, or bypass capacitor C2 is connected in parallel to, that is, across the diodes D1, D2.

OPERATION

Diode D2 provides for charging capacitor C1 over the lamp circuit, so that capacitor C1 will form a supply capacitor. The charge on capacitor C1 is transferred over the diode D1 on the d-c intermediate circuit and, together with the charge on the smoothing capacitor C3, ensures that when the network power supply passes through zero or null, the supply voltage will still be of sufficient value in order to maintain the half-bridge inverter circuit 3 in operation. The second capacitor C2 permits maintenance of the lamp current in negative direction and, at the same time, functions as a coupling capacitor.

Figure 3:
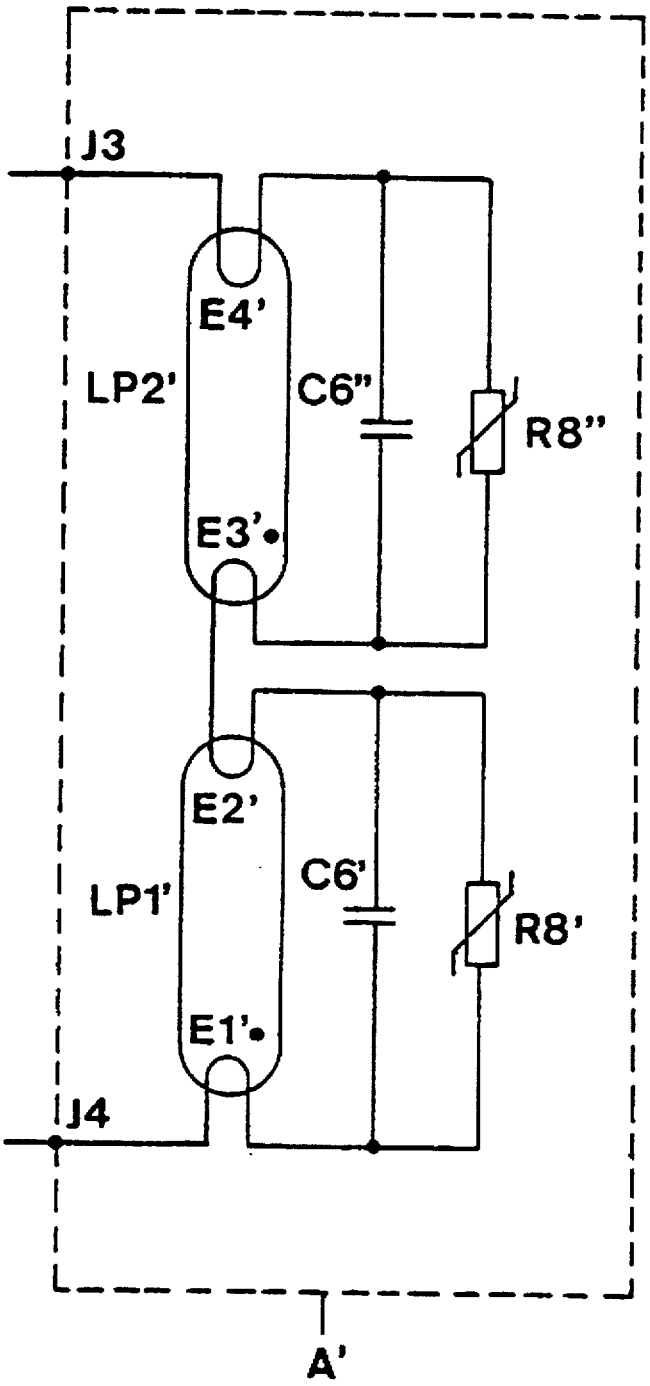
FIG. 3 is a fractional part diagram illustrating lamp connections and a pre-heat circuits for two serially connected low-power low-pressure discharge lamps, for example fluorescent lamps.

FIG. 3 illustrates how the circuit can be used with multiple serially connected low-pressure discharge lamps. FIG. 3 shows two serially connected low-pressure discharge lamps LP1', LP2' rather than the single low-pressure discharge lamp. The connection of the lamps replaces the portion of the circuit within the broken line box A of FIG. 2, and the connection is at junctions J3 and J4. As best seen in FIG. 3, the electrode E1' of the first lamp LP1' is connected through junction J4 with the center terminal M1. The second electrode E4' of the second lamp LP2' is connected through junction J3 and through the filter network with the positive terminal J1 of the rectifier. Resonance capacitors C6' and C6", respectively, as well as PTC resistors R8' R8" are connected in parallel to the respective lamp LP1', LP2', as clearly illustrated in FIG. 3.

Suitable circuit values to operate 8 W fluorescent lamps LP1 from a 230 V a-c supply are shown in the column below.

FD1, FD2: 1.5 mH, BC
D3–D6: rectifier bridge B250 C800
D1, D2, D7: 1N4005
C1: 1 μF
C2, C3: 0.22 μF
C4: 0.1 μF
C5: 1.5 nF
C6: 3.3 nF
DC: Diac 1N413M
R1: 10 kΩ
R2, R7: 820 kΩ
R3, R4: 22 Ω
R5, R6: 1 Ω
R8: Resistor PTC-C890
RKA: 5 winding turns
RKB, RKC: 3 winding turns
L1: 3.5 mH, EF16
T1,T2: BUD 93

I claim:

1. In combination with at least one low-power, low-pressure discharge lamp (LP1, LP1', LP2') defining one, or a plurality of lamps, wherein said lamps of the plurality are serially connected, an energy supply circuit adapted for connection to a source of a-c electrical energy including a rectifier (2) having d-c output terminals (J1, J2);

a smoothing capacitor (C3) connected across the d-c output terminals;

a half-bridge inverter (3) having two alternately conducting controlled semiconductor switches (T1, T2) and defining a common junction (M1);

a series resonance circuit having a resonance inductance (L1), and a resonance capacity (C6, C6', C6") coupled to the at least one discharge lamp, or lamps (LP1, LP1', LP2');

a first connection means coupling the first electrode (E1, E1') of the lamp (LP1) or a first lamp (LP1') to the resonance inductance (L1) and then to the common junction (M1) between the two semiconductor switches (T1, T2);

a second connection means connecting the second electrode (E2, E4') of the lamp (LP1) or, for a plurality of lamps, that one lamp (LP2') which is the last one of the serially connected plurality of lamps (LP1', LP2') with one (J1) of the output terminals (J1, J2) of the rectifier, said energy supply circuit further comprising, in accordance with the invention, a passive filter circuit (5) consisting essentially of only two serially connected diodes (D1, D2) defining a common junction (M2) connected, in d-c blocking direction, in the second connection means between the second electrode (E2, E4'), of the lamp LP1, or said last one (LP2') of said serially connected plurality of lamps (LP1', LP2') and said one (J1) of the rectifier output terminals (J1, J2);

a first capacitor (C1) connected to said common junction (M2) between said two serially connected diodes (D1, D2) and coupled to the other (J2) of the output terminals (J1, J2) of the rectifier (2); and a second capacitor (C2) connected in parallel with said two serially connected diodes (D1, D2).

2. The energy supply circuit of claim 1, wherein the relationship of capacity of said first capacitor (C1) and said second capacitor (C2) is $$C1/C2 \geqq 4 \quad (1).$$

3. The energy supply circuit of claim 1, wherein the capacity value of said first capacitor (C1) is substantially greater than the capacity value of said second capacitor (C2).

* * * * *